US011371227B2

(12) United States Patent
Cobb

(10) Patent No.: US 11,371,227 B2
(45) Date of Patent: Jun. 28, 2022

(54) DRAIN HAIR CATCHER

(71) Applicant: Lolita Cobb, Bessemer, AL (US)

(72) Inventor: Lolita Cobb, Bessemer, AL (US)

( * ) Notice: Subject to any disclaimer, the term of this patent is extended or adjusted under 35 U.S.C. 154(b) by 1 day.

(21) Appl. No.: 16/952,275

(22) Filed: Nov. 19, 2020

(65) Prior Publication Data

US 2021/0164207 A1 Jun. 3, 2021

Related U.S. Application Data

(60) Provisional application No. 62/943,024, filed on Dec. 3, 2019.

(51) Int. Cl.
*E03C 1/264* (2006.01)

(52) U.S. Cl.
CPC ..... *E03C 1/264* (2013.01)

(58) Field of Classification Search
CPC . E03C 1/264; E03C 1/26; E03C 1/282; E03C 1/28; E03F 5/041
USPC ..... 4/292
See application file for complete search history.

(56) References Cited

U.S. PATENT DOCUMENTS 774,201 A * 11/1904 Robischon ..... E03C 1/264 4/291
1,467,772 A * 9/1923 Appelhoff ..... E03C 1/264 4/291
2,094,286 A * 9/1937 Vogt ..... E03C 1/264 4/292
3,788,485 A * 1/1974 Bruning ..... E03C 1/264 210/474
5,297,299 A * 3/1994 Wilson ..... E03C 1/264 4/290
7,951,292 B1 * 5/2011 De La Torre ..... E03C 1/264 210/336
2010/0011494 A1 * 1/2010 Dees ..... E03C 1/264 4/292
2016/0040410 A1 * 2/2016 Carpenter-Crawford ..... B05B 1/06 4/652
2018/0320924 A1 * 11/2018 Bryant ..... F24F 13/082
2019/0145654 A1 * 5/2019 Bryant ..... F16L 55/24 138/96 R
2020/0217055 A1 * 7/2020 Robillard ..... E03F 5/06
2020/0370287 A1 * 11/2020 West ..... E03C 1/264

* cited by examiner

*Primary Examiner* — Benjamin R Shaw
(74) *Attorney, Agent, or Firm* — Boyle Fredrickson S.C.

(57) ABSTRACT

A hair collector assembly includes a flat disk having an outer circular or oval frame supporting an inner mesh material that can be placed over the drain opening to block the opening. The outer circular frame may include a lower ring contacting the upper surface of the sink or tub and preventing movement of the disk. The lower ring may snap into an upper ring which together retain an outer perimeter of a mesh material forming an inner surface of the disk and preventing the passing of hair, grease, and other sticky substances through the mesh material into the drain.

18 Claims, 2 Drawing Sheets

DRAIN HAIR CATCHER

CROSS REFERENCE TO RELATED APPLICATION

This application claims the benefit of U.S. Provisional Patent Application No. 62/943,024, filed Dec. 3, 2019, which is incorporated by reference herein in its entirety.

BACKGROUND OF THE INVENTION

The present invention relates generally to a hair catcher installed over a drain opening and, in particular, to a hair catcher with a replaceable mesh preventing hair, grease, and sticky substances from passing through the hair catcher while still allowing liquid to pass through and drain.

Drains can get easily clogged by hair, grease, and other sticky substances that bind together to form clogs within a drain pipe. Hair is particularly troublesome in that it binds to soap on the walls of drain pipes which over time accumulate to obstruct the drain pipe and reduce water flow. The most common way to prevent air blockages is to prevent hair and debris from entering drains in the first place.

SUMMARY OF THE INVENTION

The present invention provides a hair collector assembly in the form of a flat disk having an outer circular or oval frame supporting an inner mesh material that can be placed over the drain opening to block the opening. The outer circular frame may include a lower ring contacting the upper surface of the sink or tub and preventing movement of the disk. The lower ring may snap into an upper ring which together retain an outer perimeter of a mesh material forming an inner surface of the disk and preventing the passing of hair, grease, and other sticky substances through the mesh material into the drain.

The lower ring may include an elastomeric sealing material made of, for example, rubber or silicone, preventing the displacement of the disk from around the sink or tub drain opening.

The disk may have a diameter that is between 2 inches and 8 inches and is generally at least 25% to 50% larger than a diameter of the sink or tub drain opening.

The outer circular frame may be various colors such as black and white.

One embodiment of the present invention provides a drain hair catcher having a first ring; a second ring interconnectable with the first ring about a circumference of the first and second interconnectable rings; and a mesh material clamped between the circumference of the first and second interconnecting rings wherein the mesh material has openings that prevent an average human hair to pass through.

It is thus a feature of at least one embodiment of the present invention to provide simplified drain cover that is adaptable to fit over many different drain shapes and sizes.

The mesh material may be at least 200 mesh number. The mesh material may be at least 230 mesh number.

It is thus a feature of at least one embodiment of the present invention to prevent very small particles or grease from entering the drain and contributing to clogs but allowing liquid to pass.

The first and second interconnected rings may have a diameter between 1 and 8 inches. The first and second interconnected rings may have a diameter between 2 and 5 inches. The first and second interconnected rings may have a diameter between 2 and 3 inches.

It is thus a feature of at least one embodiment of the present invention to allow the same drain catcher to be used over many sizes of drains.

The first ring and second ring may be interconnected by a snap fit connection. The snap fit connection may be a ball and socket.

It is thus a feature of at least one embodiment of the present invention to provide easy assembly of the drain catcher and replacement of the mesh material.

The first and second ring may be elastomer coated wires.

It is thus a feature of at least one embodiment of the present invention to allow the rings to bend and be deformed to cover uniquely shaped drain openings.

The second ring may have a downwardly extending foot of elastomeric material. The downwardly extending foot may have a trapezoidal cross section. The downwardly extending foot may be at least one of a plastic, rubber, and silicone.

It is thus a feature of at least one embodiment of the present invention to prevent movement of the drain catcher when water and other substances are being drained through the drain catcher.

Another embodiment of the present invention provides a method of preventing drain clogs comprising the steps of providing a drain hair catcher comprising a first ring, a second ring interconnectable with the first ring about a circumference of the first and second interconnectable rings, and a mesh material clamped between the circumference of the first and second interconnecting rings wherein the mesh material has openings that prevent an average human hair to pass through; and positioning the drain hair catcher over a drain to engage the second ring with an upper drain surface. These particular objects and advantages may apply to only some embodiments falling within the claims and thus do not define the scope of the invention.

DETAILED DESCRIPTION OF THE PREFERRED EMBODIMENT

Figure 1:
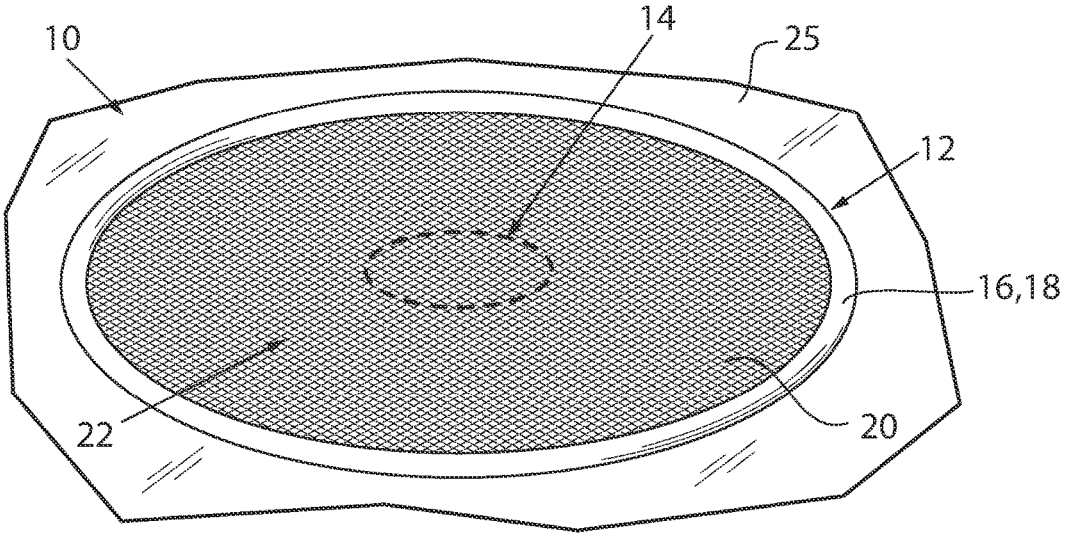
FIG. 1 is a perspective view of the assembled hair catcher assembly of the present invention for use over a sink or tub drain opening.

Referring now to FIG. 1, a hair catcher assembly 10 of the present invention may provide a disk 12 having a flat, thin structure placed over a tub or sink drain opening 14 to cover the sink drain opening 14 and prevent hair or other debris from entering the sink drain opening 14. The sink drain opening 14 may be generally centered beneath the hair catcher assembly 10.

Figure 2:
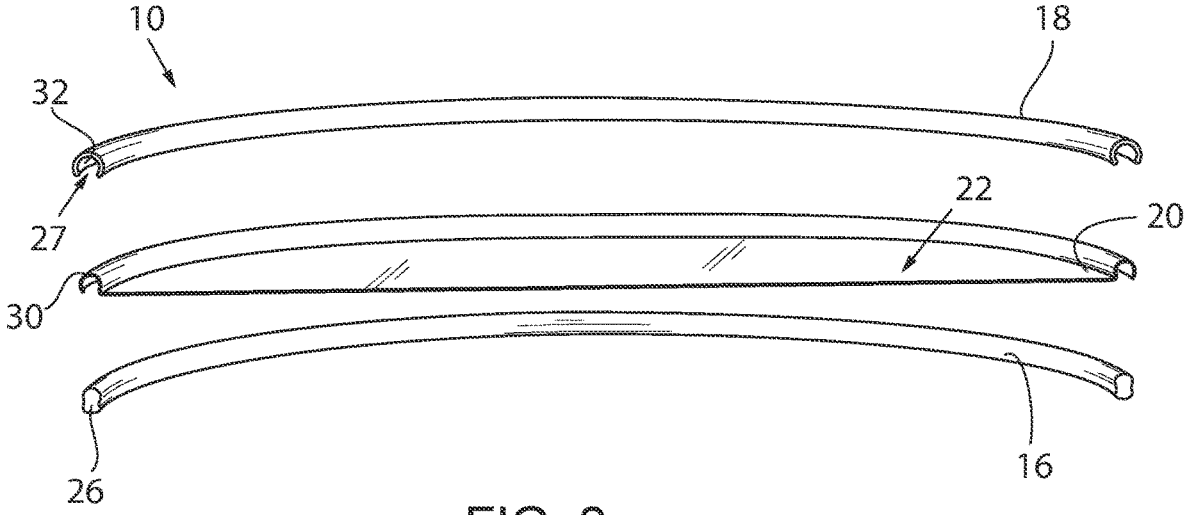
FIG. 2 is an exploded cross-sectional view of the hair catcher assembly of FIG. 1 showing an upper ring engaging a lower ring and clamping a mesh material therebetween.
Figure 3:
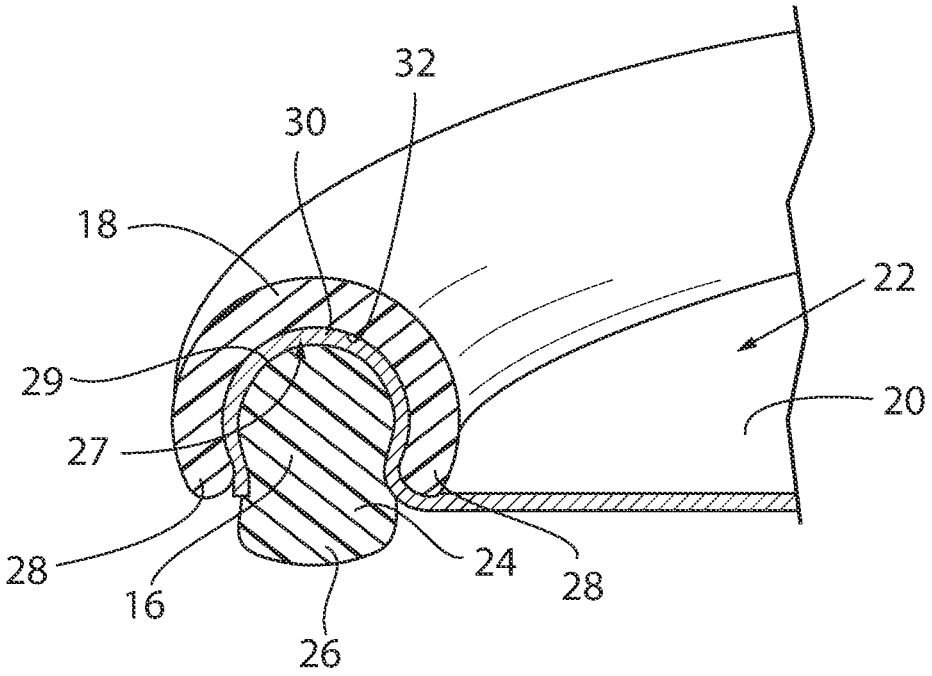
FIG. 3 is an enlarged cross-sectional view of the assembled hair catcher assembly of FIG. 1 showing the lower ring, upper ring, and mesh material inter-engaging to form the hair catcher assembly.

Referring also to FIGS. 2 and 3, in one embodiment, the hair catcher assembly 10 may by a circular disk 12 providing a lower ring 16 coupled to an upper ring 18 to form an outer perimeter of the circular disk 12. The lower ring 16 and upper ring 18 may be generally equal in diameter and may interlock as further described below. The interlocking lower ring 16 and upper ring 18 retain an outer perimeter of a circular mesh material 20 therebetween, the mesh material 20 forming an interior planar surface 22 of the disk 12.

The lower ring 16 may be a ring of durable and water-resistant material having a generally solid, circular cross-section. In one embodiment, the lower ring 16 may be formed by an elastomer coated wire, for example, a plastic, rubber, vinyl, nylon, urethane, polyester, polyvinyl chloride (PVC), and polypropylene (PP) coated wire. The wire provides the desired stiffness and resilience to the lower ring 16 so that the lower ring 16 retains its shape after bending, stretching or compression. The coating on the wire prevents the wire from corroding and reduces the wear and tear on the wire. A diameter of the lower ring 16 may be between 1 inch and 8 inches and between 2 inches and 5 inches and between 2 inches and 3 inches and may generally be 25% to 50% and at least 25% larger and at least 30% larger and at least 35% larger and at least 40% larger and at least 45% larger than a diameter of the sink drain opening 14.

A bottom end 24 of the lower ring 16 contacting the upper sink surface 25 may include an outwardly expanding sealing foot 26 having a generally trapezoidal cross-section. The sealing foot 26 may be formed of elastomeric or rubber-like materials, for example, plastic, rubber or silicone or other common gasket materials, for example, felt and non-woven material, preventing the movement of the disk 12 around the sink drain opening 14 and sticking the sealing foot 26 to the upper tub or sink surface 25 surrounding the sink drain opening 14.

The upper ring 18 may be a half round channel formed into a ring having a generally semicircular cross-section with a lower concave opening 27. The opposed bottom edges 28 of the upper ring 18 flanking the concave opening extend downwardly and converge inwardly toward each other to receive an upper end 29 of the lower ring 16 therein as further described below. The upper ring 18 may be formed of a durable and water resistant elastomeric or rubber-like material, for example, plastic, rubber or silicone. A diameter of the lower ring 16 may be between 2 inches and 8 inches and generally at least 25% to 50% larger than a diameter of the sink drain opening 14.

The upper ring 18 and lower ring 16 may have substantially the same diameter allowing the upper ring 18 and lower ring 16 to snap together to form a perimeter of the disk 12 and generally conforming to known ball and socket snap fit. The opposed bottom edges 28 of the upper ring 18 may have a resilience to allow the bottom edges 28 to spread apart to receive the lower ring 16 therebetween but then rebound to its original state once the lower ring 16 is received within the concave opening 27 to retain the lower ring 16 there.

It is understood that the lower ring 16 and upper ring 18 may interlock by alternative methods of connection, such as other known snap fit designs, for example, cantilevered snap fits and annular snap fits.

Clamped between the upper ring 18 and lower ring 16 is a mesh material 20 forming a circular interior planar surface of the disk 12 and retained at its outer edges 30 by the clasping of the upper ring 18 and lower ring 16. The mesh material 20 is generally clamped between the upper end 29 of the lower ring 16 and the inner surface 32 of the concave opening 27 of the upper ring 18. The mesh material 20 is generally stretched and held taunt within the upper ring 18 and lower ring 16 to form the interior planar surface 22 of the disk 12. The hair catcher assembly 10 may be assembled by clamping a larger piece of mesh material 20, sized larger than the upper ring 18 and lower ring 16, between the upper ring 18 and lower ring 16 and then cutting down the larger mesh material 20 to the size of the upper ring 18 and lower ring 16 once it is clamped by the upper ring 18 and lower ring 16.

On some embodiments, the mesh material 20 may be an at least 200 mesh number (200 openings per square inch or sieve size of 0.074 mm) or an at least 230 mesh number (230 openings per square inch or sieve size of 0.063 mm) thus preventing an average human hair 0.075 mm in diameter from penetrating the mesh material 20. In some embodiments, the mesh material 20 may be an at least 270 mesh number (270 openings per square inch or sieve size of 0.053 mm) or at least 325 mesh number (325 openings per square inch or sieve size of 0.044 mm). The mesh may be constructed of connected strands of metal, fiber, or other flexible or ductile materials.

It is understood that the mesh material 20 may initially be a larger sheet of material sized to be larger than the upper ring 18 and lower ring 16 and which is then cut down to a size and shape generally corresponding to an outer diameter of the upper ring 18 and lower ring 16 after being securely retained by the upper ring 18 and lower ring 16. In this respect it is easier to trap the mesh material 20 between the upper ring 18 and lower ring 16 during the assembly process.

It is understood that the disk 12 may be various colors such as black or white. It is also understood that the disk 12 may be any shape that covers the sink drain opening 14, such as oval or rectangular shaped.

Certain terminology is used herein for purposes of reference only, and thus is not intended to be limiting. For example, terms such as "upper," "lower," "above," and "below," refer to directions in the drawings to which reference is made. Terms such as "front," "back," "rear," "bottom," and "side," describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

When introducing elements or features of the present disclosure and the exemplary embodiments, the articles "a," "an," "the," and "said," are intended to mean that there are one or more of such elements or features. The terms "comprising", "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What I claim is:

1. A drain hair catcher comprising:

a first ring;

a second ring interconnectable with the first ring about a circumference of the first and second interconnecting rings; and a mesh material clamped between the circumference of the first and second interconnecting rings;

wherein the mesh material has openings that prevent an average human hair to pass through; and wherein the first ring and second interconnected rings are interconnected by a snap fit connection.

2. The drain hair catcher of claim 1 wherein the mesh material is at least 200 mesh number.

3. The drain hair catcher of claim 2 wherein the mesh material is at least 230 mesh number.

4. The drain hair catcher of claim 1 wherein the first and second interconnected rings have a diameter between 1 inch and 8 inches.

5. The drain hair catcher of claim 4 wherein the first and second interconnected rings have a diameter between 2 and 5 inches.

6. The drain hair catcher of claim 5 wherein the first and second interconnected rings have a diameter between 2 and 3 inches.

7. The drain hair catcher of claim 1 wherein the snap fit connection is a ball and socket.

8. A drain hair catcher comprising:

a first ring;

a second ring interconnectable with the first ring about a circumference of the first and second interconnecting rings; and a mesh material clamped between the circumference of the first and second interconnecting rings;

wherein the mesh material has openings that prevent an average human hair to pass through; and wherein the first and second interconnected rings are elastomer coated wires.

9. A drain hair catcher comprising:

a first ring;

a second ring interconnectable with the first ring about a circumference of the first and second interconnecting rings; and a mesh material clamped between the circumference of the first and second interconnecting rings;

wherein the mesh material has openings that prevent an average human hair to pass through; and wherein the second ring has a downwardly extending foot of elastomeric material.

10. The drain hair catcher of claim 9 wherein the downwardly extending foot has a trapezoidal cross section.

11. The drain hair catcher of claim 10 wherein the downwardly extending foot is at least one of a plastic, rubber, and silicone.

12. A method of preventing drain clogs comprising the steps of:

providing a drain hair catcher comprising a first ring, a second ring interconnectable with the first ring about a circumference of the first and second interconnecting rings, and a mesh material clamped between the circumference of the first and second interconnecting rings, wherein the mesh material has openings that prevent an average human hair to pass through; and positioning the drain hair catcher over a drain to engage the second ring with an upper drain surface wherein the second ring has a downwardly extending foot of elastomeric material.

13. The method of claim 12 wherein the mesh material is at least 200 mesh number.

14. The method of claim 13 wherein the mesh material is at least 230 mesh number.

15. The method of claim 12 wherein the downwardly extending foot has a trapezoidal cross section.

16. The method of claim 15 wherein the downwardly extending foot is at least one of a plastic, rubber, and silicone.

17. The method of claim 12 wherein a diameter of the first and second interconnected rings is at least 25% greater than a diameter of the drain.

18. The method of claim 17 wherein the diameter of the first and second interconnected rings is 25% to 50% greater than a diameter of the drain.

* * * * *